US006343857B1

(12) United States Patent
Cowger

(10) Patent No.: US 6,343,857 B1
(45) Date of Patent: Feb. 5, 2002

(54) INK CIRCULATION IN INK-JET PENS

(75) Inventor: Bruce Cowger, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 08/192,224

(22) Filed: Feb. 4, 1994

(51) Int. Cl.[7] ..... B41J 2/18
(52) U.S. Cl. ..... 347/89
(58) Field of Search ..... 347/89, 85, 17, 347/18

(56) References Cited

U.S. PATENT DOCUMENTS

| | | | | | |
|---|---|---|---|---|---|
| 3,929,071 | A | | 12/1975 | Cialone et al. | 101/335 |
| 4,318,114 | A | | 3/1982 | Huliba | 346/140 R |
| 4,383,263 | A | | 5/1983 | Ozawa et al. | 346/140 R |
| 4,394,669 | A | | 7/1983 | Ozawa et al. | 346/140 R |
| 4,432,003 | A | * | 2/1984 | Barbero et al. | 347/89 |
| 4,433,341 | A | | 2/1984 | Thomas | 346/140 R |
| 4,462,037 | A | | 7/1984 | Bangs et al. | 346/140 R |
| 4,500,895 | A | | 2/1985 | Buck et al. | 346/140 R |
| 4,527,175 | A | | 7/1985 | Kojima et al. | 346/140 R |
| 4,614,948 | A | | 9/1986 | Katerberg et al. | 346/75 |
| 4,680,859 | A | | 7/1987 | Johnson | 29/611 |
| 4,683,481 | A | | 7/1987 | Johnson | 346/140 R |
| 4,694,308 | A | | 9/1987 | Chan et al. | 346/140 R |
| 4,746,935 | A | | 5/1988 | Allen | 346/140 R |
| 4,788,556 | A | | 11/1988 | Hoisington et al. | 346/1.1 |
| 4,791,438 | A | | 12/1988 | Hanson et al. | 346/140 R |
| 4,812,859 | A | | 3/1989 | Chan et al. | 346/140 R |
| 4,814,786 | A | | 3/1989 | Hoisington et al. | 346/1.1 |
| 4,831,389 | A | | 5/1989 | Chan | 346/140 R |
| 4,872,027 | A | | 10/1989 | Buskirk et al. | 346/140 R |
| 4,882,595 | A | | 11/1989 | Trueba et al. | 346/140 R |
| 4,910,528 | A | | 3/1990 | Firl et al. | 346/1.1 |
| 4,929,963 | A | | 5/1990 | Balazar | 346/1.1 |
| 4,937,598 | A | | 6/1990 | Hine et al. | 346/140 R |
| 4,953,287 | A | | 9/1990 | West et al. | 29/611 |
| 5,016,023 | A | | 5/1991 | Chan et al. | 346/1.1 |
| 5,017,941 | A | | 5/1991 | Drake | 347/18 |
| 5,084,713 | A | | 1/1992 | Wong | 346/1.1 |
| 5,153,612 | A | | 10/1992 | Dunn et al. | 346/140 R |
| 5,291,215 | A | * | 3/1994 | Nozawa et al. | 347/89 |

FOREIGN PATENT DOCUMENTS

| | | | | |
|---|---|---|---|---|
| DE | 2828998 | * | 1/1980 | 347/89 |
| EP | 0382423 | | 2/1990 | B41J/2/175 |
| EP | 0518380 | | 6/1992 | B41J/2/175 |
| EP | 0600393 | | 11/1993 | B41J/29/377 |
| GB | 2134040 | * | 8/1984 | 347/89 |
| WO | WO8902577 | | 3/1989 | G01D/15/16 |

* cited by examiner

*Primary Examiner*—Judy Nguyen

(57) ABSTRACT

The print heads of ink-jet pens are supplied with ink that is circulated to and from the print head. Passageways defined by the pen are oriented in fluid communication with the firing chambers of the print head and so that ink circulates in the vicinity of the chambers irrespective of whether the print head is activated for ejecting ink drops.

11 Claims, 5 Drawing Sheets

FIG. 3
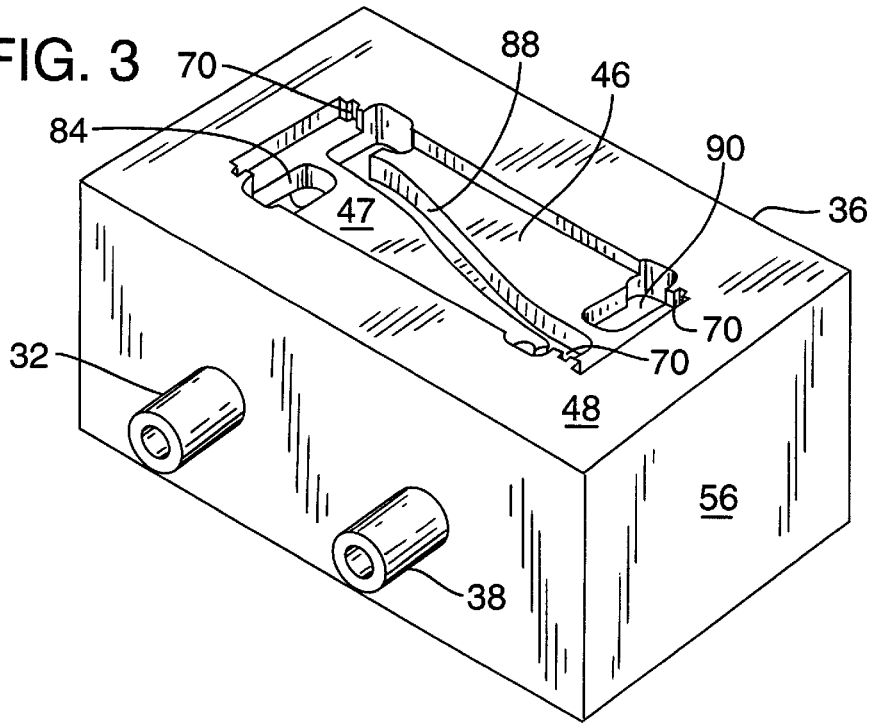
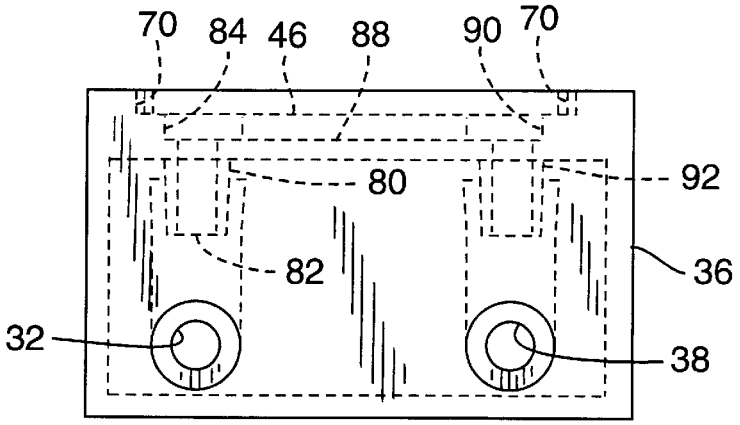
FIG. 4
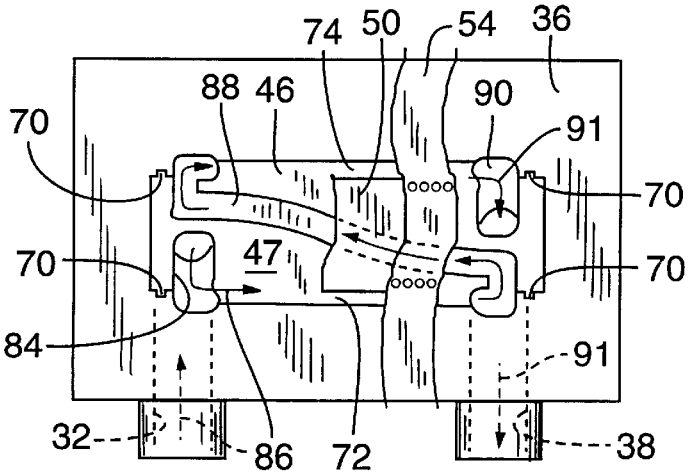
FIG. 5

INK CIRCULATION IN INK-JET PENS

TECHNICAL FIELD

The present invention is directed to systems for supplying ink to the print heads of ink-jet printer pens.

BACKGROUND AND SUMMARY OF THE INVENTION

Pens used with ink-jet printers include print heads that eject minute droplets of ink through nozzles. An ink supply reservoir is associated with the pen. Certain print heads, known as drop-on-demand type, employ thermal or piezoelectric mechanisms that are responsive to control signals for expanding or compressing, respectively, small volumes of ink near each print head nozzle to eject drops therefrom onto print media.

The ink supplied from the pen reservoir flows in a single path toward the print head and out a nozzle. When nozzles are not ejecting drops, there is substantially no flow of supply ink in the vicinity of the nozzle. When the printer is activated but between printing operations, the flow of supply ink is generally still with respect to the entire print head.

The present invention is directed to ink circulation in ink-jet pens, and particularly to a system for supplying ink to a print head in such a manner that the ink circulates with respect to the print head nozzles while the printer is activated, irrespective of whether the print head is simultaneously operating to eject ink drops.

The present invention may be embodied in a pen employing a single print head, or in a pen that employs several print heads.

The circulation system provides numerous advantages to the printing operation. For example, ink circulation facilitates the removal of air from ink. In this regard, air tends to diffuse into the ink supply, especially when the fluid pressure of the supply is maintained slightly below ambient, as is required with many ink-jet pen designs for the purpose of avoiding leakage of ink through inactive nozzles.

The ink circulation system is also effective for dissipating heat that may be generated by the print head. In instances where more than one print head is employed, the circulation system across all print heads tends to evenly distribute the heat so that the entire array of print heads operate at substantially the same temperature.

In accordance with another aspect of this invention, the heat-dissipation effects mentioned above may be regulated by the incorporation of a heat exchanger for promoting even heat distribution and for maintaining a constant, optimum, operating temperature for the print head.

The ink circulation system, when employed with pens using color inks, helps to prevent changes in the relative concentrations of dye and solvents that may otherwise occur in systems where non-circulating ink is present.

BRIEF DESCRIPTION OF THE DRAWINGS

FIG. 3 is a perspective view of the pen of FIG. 2 showing the print head removed.

FIG. 4 is a side view of the pen depicted in FIG. 3.

FIG. 5 is top plan view of the pen depicted in FIG. 3.

DESCRIPTION OF PREFERRED EMBODIMENTS

Figure 1:
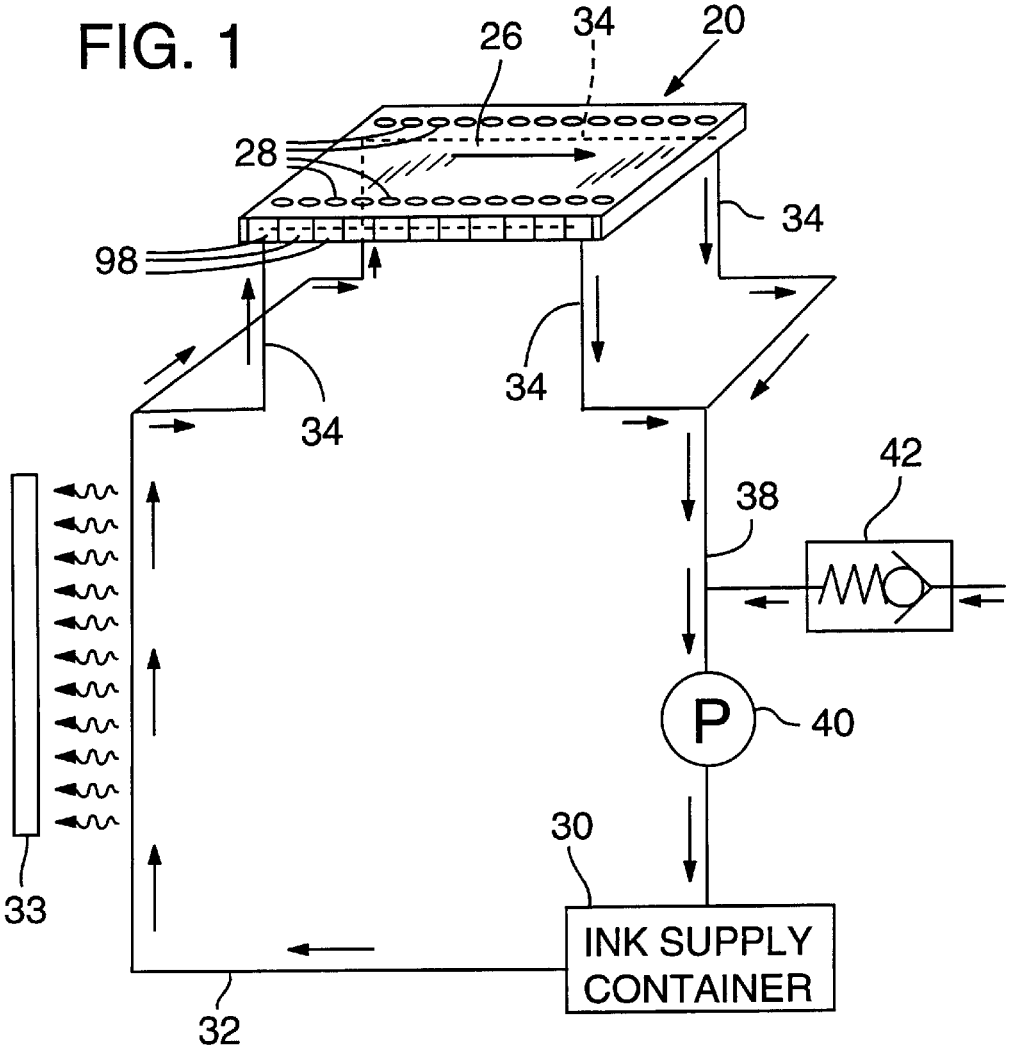
FIG. 1 is a diagram of an ink circulation system for an ink-jet pen in accordance with the present invention.

The diagram of FIG. 1 schematically depicts an ink circulation system for supplying ink to the print head of an ink-jet pen in accordance with the present invention. The print head 20 is covered on its outer surface with a nozzle plate 26 that has formed in it two rows of minute nozzles 28. Each individual nozzle in the nozzle plate 26 is in fluid communication with a firing chamber 98 in the print head, as explained more fully below. Each firing chamber 98 has associated with it a thin-film resistor that is selectively driven (heated) with sufficient current for instantaneously vaporizing some of the ink that enters the chamber, thereby forcing a drop of ink through the nozzle.

The present invention provides a circulation system for continuously circulating ink in the vicinity of the print head firing chambers and nozzles, irrespective of whether any of the firing chambers are simultaneously activated to eject ink drops.

With reference to FIG. 1, the system includes an ink supply 30 that comprises any container suitable for storing a supply of ink. A supply conduit 32 conducts ink from the supply container 30 to an ink circulation passageway 34 defined by the print head 20 and the pen body 36 (FIG. 3) to which the print head is mounted. The ink circulation passageway 34 is configured so that ink moving therethrough is in fluid communication with an entry region of each firing chamber 98, thereby providing a continuously circulating supply of ink to each firing chamber.

The ink circulation passageway leads to a return conduit 38 to which is connected a diaphragm pump 40 that provides the pressure gradient for generating the ink flow through the system.

In a preferred embodiment, the fluid pressure within the system is maintained slightly below ambient so that ink will not leak from the print head nozzles 28 when the firing chambers are inactive. It is desirable, however, to regulate the pressure within the system so that the partial vacuum or back pressure established in the system does not become so high as to prevent the drop-ejection forces generated in the firing chambers from overcoming the back pressure. To this end, a vacuum regulator 42 is connected to the return conduit 38 (or to any other location in the system) to permit the limited entry of ambient air into the system in the event the pressure within the system drops below a predetermined threshold level. Preferably, the vacuum regulator 42 is adjustable for changing the threshold level as necessary.

Figure 2:
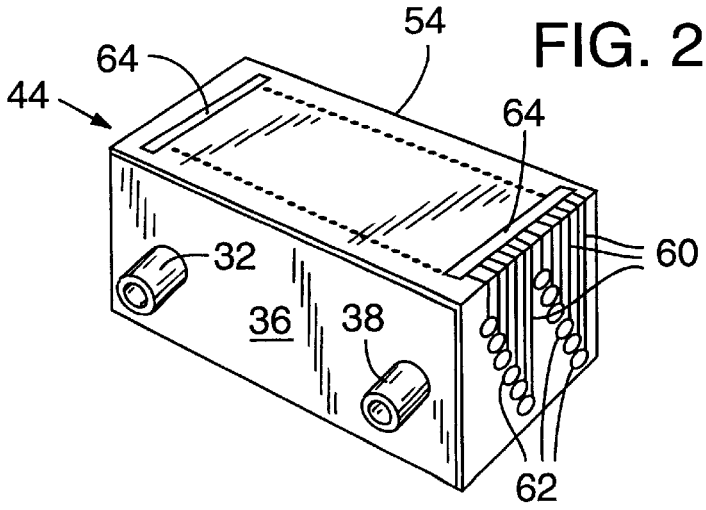
FIG. 2 is a perspective view of an ink-jet pen incorporating an ink circulation system in accordance with the present invention.
Figure 6:
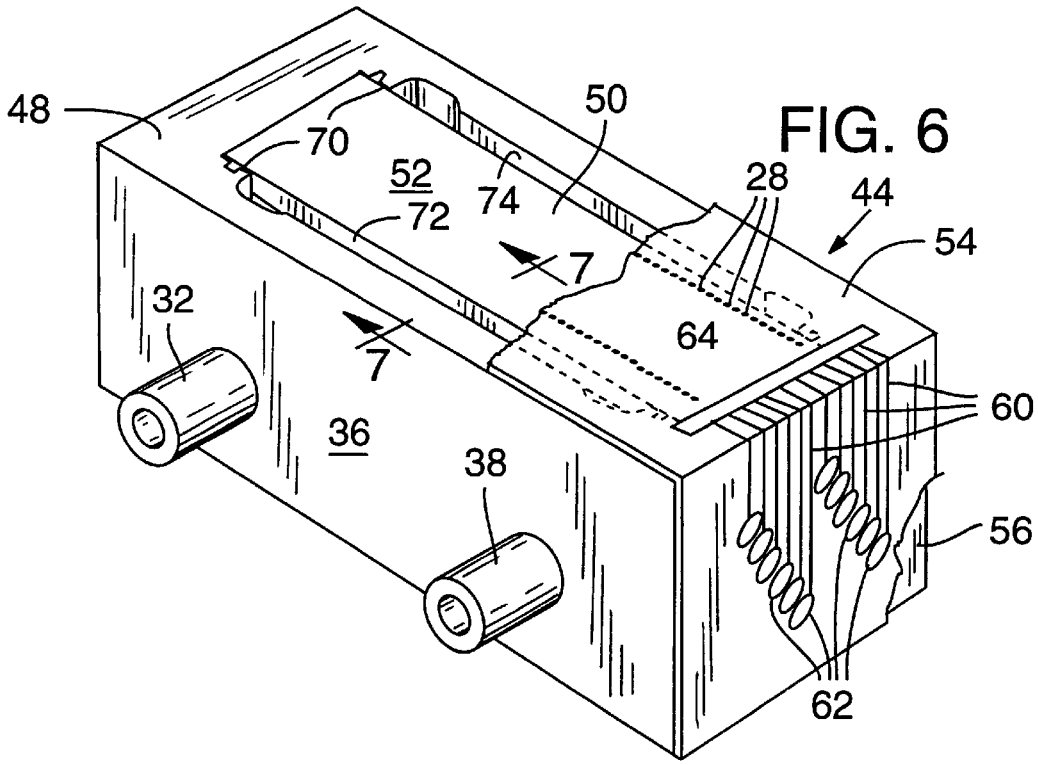
FIG. 6 is an enlarged perspective view, partly broken away, of the pen of FIG. 2.

FIGS. 2–7 depict the particulars of an ink-jet pen as constructed to incorporate the ink circulation system of the present invention. With particular reference to FIGS. 2, 3 and 6, the pen 44 includes a plastic body 36 in which is formed an oblong recess 46 (FIG. 3). The recess 46 is formed in the surface 48 of the pen body that faces the printing medium during operation of the pen. A print head 50 (FIG. 6), generally corresponding to the shape of the recess 46 fits within the recess and is mounted thereto such as by bonding with adhesives. The outer surface 52 of the print head 50 and the surface 48 of the pen body 36 are covered with a flexible circuit 54 that also extends to cover an adjacent surface 56 of the pen body.

The flexible circuit 54 may be staked to the pen body 36. Specifically, the circuit is applied to the exterior surfaces 48, 56 of the pen body 36 under pressure and heat sufficient for causing plastic flow of the pen body so that the underside of the flexible circuit 54 is joined to the pen body 36.

The surface of the circuit 54 that covers the upper surface 52 of the print head has defined in it the above-mentioned arrays of nozzles 28, each nozzle being in fluid communication with a firing chamber defined by the print head. The above-mentioned nozzle plate, therefore, is defined by the flexible circuit.

In a preferred embodiment, the flexible circuit 54 comprises a strip of polyimide, the underside of which (that is, the side of the strip that is staked to the pen body 36) has bonded thereto a multitude of copper traces 60, a few of which are enlarged and shown for illustrative purposes in FIGS. 2 and 6. Each trace 60 connects at one end to an embossed contact pad 62 on the circuit 54. Each pad 62 mates with corresponding contacts mounted on a printer carriage. The mating contacts permit delivery of control signals from the printer to the pen. The other ends of the traces 60 terminate in free ends or "beams" that are welded to corresponding conductors carried on the print head 50. In this regard, windows 64 are provided through the flexible circuit 54. The beams of the traces protrude into the windows and are exposed there for welding to the conductors on the print head. A method and associated apparatus for attaching a flexible circuit to a pen body is described in U.S. Pat. No. 5,189,787, owned by the assignee of the present application, and herein incorporated by reference.

The pen body 36 and the print head 50 combine to define the above-mentioned ink passageway 34 for permitting circulating flow of ink to and from the firing chambers of a print head. The ink passageway 34 is made up of a number of portions, as described below.

With particular reference to FIGS. 3–7 the recess 46 in the pen body 36 is constructed to be generally wider than the print head 50, except at the ends of the recess, where opposing alignment features 70 protrude inwardly toward the longitudinal center line of the recess. The distance between the pair of alignment features 70 at each end of the recess substantially matches the width of the print head 50. As a result, these features secure the print head with its longitudinal. center line matching that of the recess.

The long side edges of the print head 50 are spaced from the corresponding long side edges of the recess. This spaced relationship, therefore, defines an elongated first ink passageway 72 extending the substantial length of one side of the print head 50, and a corresponding, second ink passageway 74, extending along the substantial length of the other side of the print head (FIG. 6). It will be appreciated that with the flexible circuit 54 in place, the passageways 72, 74 are substantially enclosed along their length by the print head 50, pen body 36 and the underside of the circuit 54.

With reference to FIGS. 4 and 5, the supply conduit 32 could be, for example, a tube that passes through, or is part of, the pen body 36 to connect with the end of an inflow standpipe 80 that protrudes downwardly from the top of the pen body 36. Preferably, the end of the inflow standpipe 80 is covered with a fine-mesh screen 82 to prevent the entry of foreign matter into the vicinity of the print head. The bore of the inflow standpipe 80 provides a continuous path with that of the conduit 32. An inflow channel 84 is formed in the recessed surface 47 of the pen body 36 to connect the inflow standpipe 80 with the inflow or upstream end of the first ink passageway 72. Accordingly, ink flowing into the pen body 36 through supply conduit 32 passes through the inflow standpipe 80 and through the inflow channel 84 and ink passageway 72 as shown by arrows 86 (FIG. 5).

At the opposite, downstream end of the first ink passageway 72 the ink flows through a cross channel 88 that is formed in the recessed surface 47 of the pen body. The cross channel delivers the circulating ink to the opposite long side of the recess 46 so that the ink will move into one end of the second ink passageway 74 and flow along the length of that passageway. The downstream end of the passageway 74 is in fluid communication with an outflow channel 90 that is formed in the recessed surface 47 of the pen body to provide fluid communication between the passageway 74 and an outflow standpipe 92 that extends downwardly beneath the top of the pen body to connect with the above-described return conduit 38. Accordingly, ink flows through the passageway 74, through the outflow channel 90 and into outflow standpipe 92 as shown by arrows 91 (FIG. 5).

In view of the above, it will appreciated that both long sides of the print head 50, on which are defined firing chambers 98 for each nozzle, as described more fully below, are continuously supplied with circulating ink whenever the supply and return system (FIG. 1) is operating, irrespective of whether any of the print head firing chambers are being used to expel ink drops through the nozzles 28.

Figure 7:
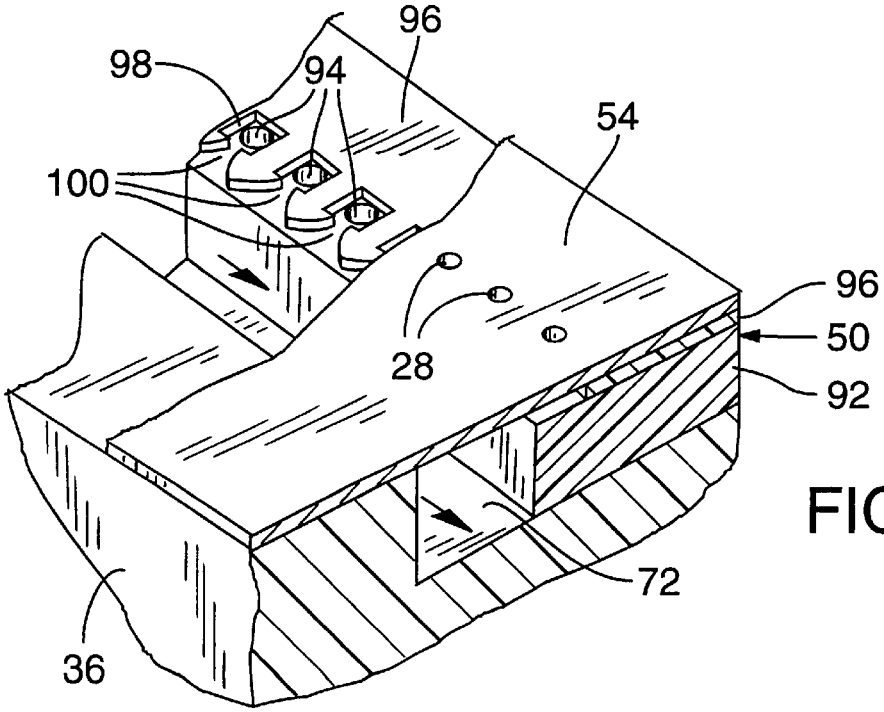
FIG. 7 is an enlarged section view showing a portion of a print head that is supplied with ink circulating in accordance with the present invention.

FIG. 7 depicts in enlarged detail the relationship between the print head firing chambers 98 and the first ink passageway 72. Specifically, the print head may be constructed to include a substrate layer 92 that carries on it a number of thin-film resistors 94, one resistor underlying a corresponding nozzle 28 in the flexible circuit 54. Each resistor 94 is electrically connected with a discrete conductive member (not shown) that is connected with a corresponding copper trace 60 of the flexible circuit as mentioned above. A thin, barrier layer 96 of polymeric material covers the substrate and is shaped by, for example, a photolithographic process to define the small-volume firing chambers 98 that surround each resistor 94. The outermost edges of the barrier 96 are shaped to define for each chamber 98 an entry region 100 through which ink may flow into the firing chamber to be heated and ejected as described above.

As can be seen upon review of FIG. 7, the first ink passageway is oriented to be in fluid communication with the print head so that ink is continuously flowing immediately adjacent the entry regions 100 of each firing chamber. Accordingly, practically no ink remains static in the vicinity of the print head. That is, the circulation system provides a continuous flow of ink across the print head firing chambers for the advantages mentioned above.

The print head construction is generally symmetrical about the longitudinal center line of the print head 50. Accordingly, it will be appreciated that, although not shown in detail, the relationship of the second ink flow passageway 74 and the print head firing chambers on the opposing side of the print head provide the same ink circulation as that of the first ink passageway 72.

Some ink-jet printer pens may be constructed to include a relatively large pen body that incorporates a plurality of print heads for correspondingly increased printing throughput. The circulation system of the present invention is readily adaptable to such a multiple print head pen as explained next with reference to FIGS. 8–10.

The multiple print head pen 144 includes a body portion that is designated a carrier 136 that carries the print heads 50 and is mounted to a base portion 137. The top 139 of the carrier 136 includes a plurality of spaced-apart recesses 146, the ends and sides of which are shaped substantially as described above with respect to recess 46, so that each print head 50 mounted within a recess 146 defines in combination with the carrier portion 136 an elongate first ink passageway 172 extending down one long side of the print head and a second ink passage 174 extending along the length on the other side of the print head.

The print heads 50 are covered with a flexible circuit 154 that has defined in it nozzles 128 and associated traces and contact pads in a manner similar to the flex circuit 54 described above. Accordingly, the flexible circuit 154 encloses the upper portion of the passageways 172, 174 at each print head. At each end of each passageway 172, 174 there is formed through the carrier a via 184. The viae 184 conduct the flow of ink in the associated ink passageway 172 or 174 between that passageway and a corresponding one of several ducts 191 that are defined by the underside of the carrier 136 and a bottom plate 185.

Figure 10:
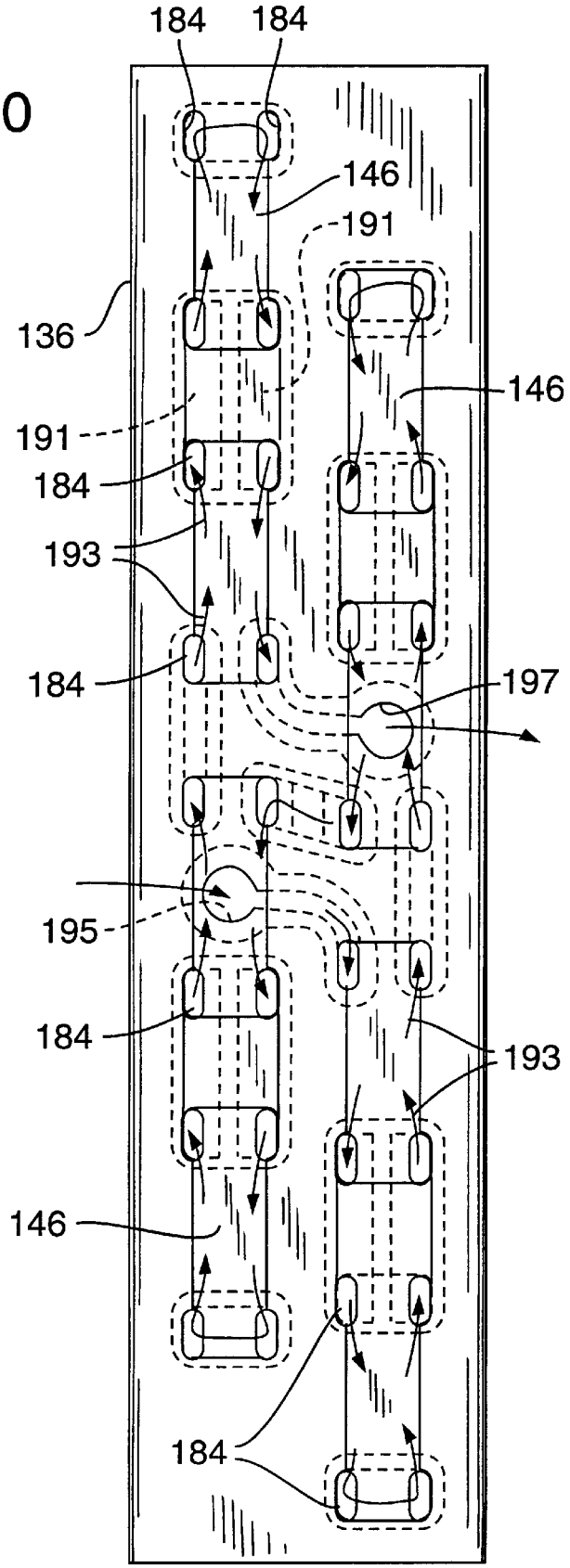
FIG. 10 is a top plan view diagram illustrating the ink circulation path of the pen of FIG. 8.

In particular, the underside of the carrier 136 is formed to include downwardly protruding ribs 187, the lowermost edges of which terminate in a common plane so that the ribs 187 evenly rest upon the upper surface 186 (see FIG. 8) of the bottom plate 185. The bottom plate 185 may be formed of any suitably rigid material. The downwardly protruding ribs 187 define in combination with the surface 186 of the bottom plate a number of the ducts 191 that connect certain viae 184 of the recesses 146 so that ink flows through passageways 172, 174 over a continuous path from print head to print head. The top view diagram of FIG. 10 shows by arrows 193 the continuous flow path of ink through the ducts 191, passageways 172, 174 and viae 184.

Figure 8:
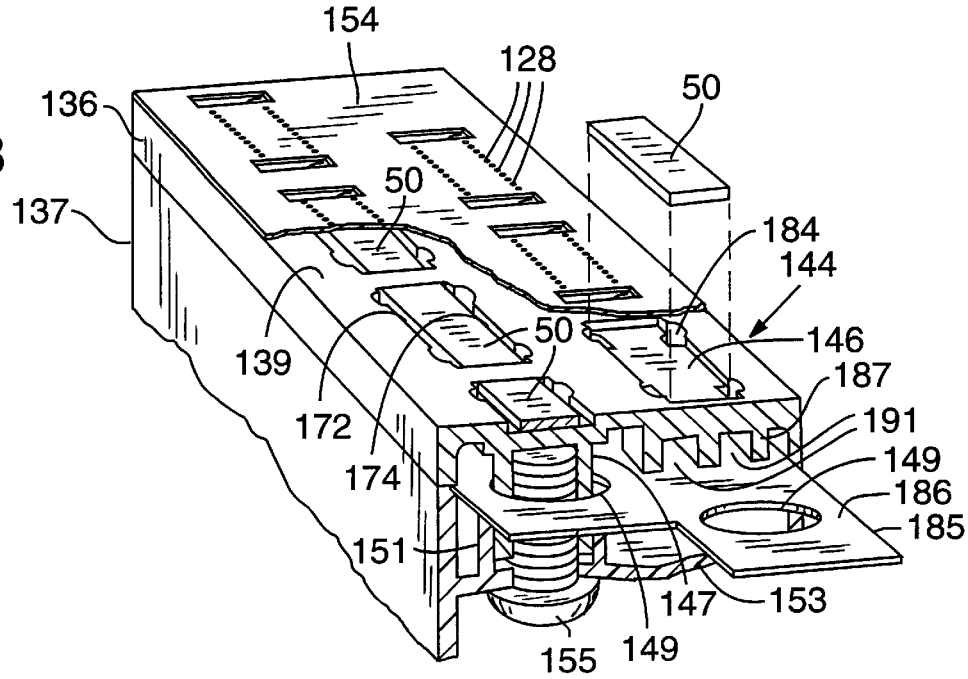
FIG. 8 is a perspective view, partly broken away, showing an ink circulation system of the present invention employed with a pen that incorporates a plurality of print heads.
Figure 9:
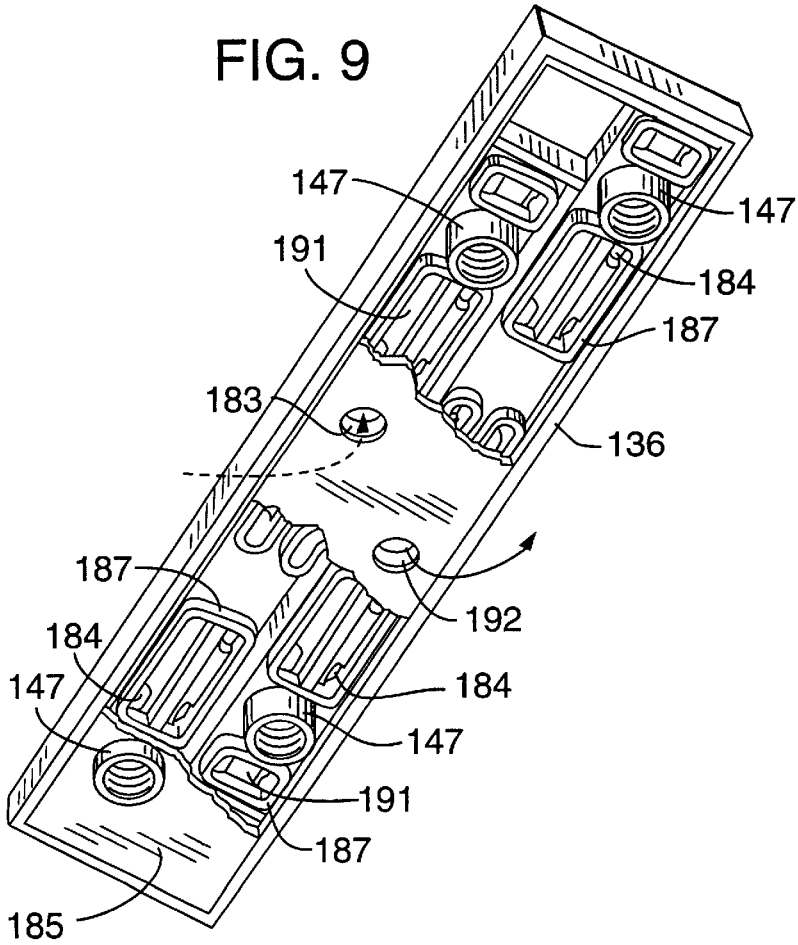
FIG. 9 is a view of the underside of a portion of the pen of FIG. 8.

The carrier 136 also has protruding from it a set of annular, space-apart bosses 147 that fit through correspondingly shaped and aligned apertures 149 in the bottom plate 185. As best shown in FIG. 8, the annular bosses 147 protrude through the bottom plate 185 and are received inside annular bosses 151 that project upwardly from a support plate 153 formed in the base 137 of the pen 144. A threaded fastener 155 is threaded into the interior threaded bore of the annual boss 147 for forcing the other boss 151 tightly against the plate 185, thereby forming a liquid-sealing contact between the ribs 187 and plate surface 186.

A pair of holes 183, 192 are formed in the bottom plate. One hole 183 aligns with a rounded end 195 (FIG. 10) of a duct 191 in the carrier. The hole 183 also receives the end of the ink supply conduit 32 (not shown) and, thus, forms an inlet to permit ink to enter the series of connected ducts 191, viae 184 and passageways 172, 174. Similarly, the other hole 192 is aligned with the end 197 of another duct 191 at the end of the continuous liquid path through the carrier 136 thereby defining an outlet to which is connected the return conduit 38.

As noted earlier, an advantage of the circulation system of the present invention is that it permits heat removal and/or even dissipation throughout the print head (or array of print heads). The heat dissipation may be regulated by the inclusion of a heat exchanger as shown at 33 in FIG. 1. In this regard, the combination of ink circulation and heat exchanger will provide uniform temperature control of circulating ink that is used with print heads having very high drop ejection speeds.

Similarly, the supply or return conduits of the ink circulation system may be connected to a mechanism that removes dissolved air from the circulating ink. One such deaeration system is described in U.S. Pat. No. 4,788,556, which describes a system for permitting the ink to flow between two permeable membranes. The sides of the membranes away from the ink are subjected to very low pressures for removing dissolved air from the ink through the membrane.

The foregoing has been described in connection with preferred and alternative embodiments. It will be appreciated, however, by one of ordinary skill in the art that various modifications and variations may be substituted for the mechanisms described here while the invention remains defined by the appended claims and their equivalents. For example, in the foregoing description, the print head firing chamber configurations have the entrances to those chambers along the side of the print head. Some print heads, however, are defined with firing chamber entrances fed from a channel in the center underside of the print head. It will be appreciated by one of ordinary skill in the art that redefining the pen body recesses to include passageways in communication with such firing chambers would be readily accomplished.

The invention claimed is:

1. An ink circulation system for an inkjet printer, comprising:

a pen body shaped to define a first location to which is mounted a print head that is operable to expel ink;

a first ink circulation passageway defined by the shape of the pen body, the passageway being in fluid communication with the print head;

a flexible circuit attached to the print head and shaped to define with the pen body a part of the first ink circulation passageway; and circulation means for continuously moving ink into and out of the first ink circulation passageway thereby to place moving ink in fluid communication with the print head irrespective of whether the print head is simultaneously operating to expel ink.

2. The system of claim 1 wherein the circulation means includes channels formed in the pen body for circulating the ink to and from the print head.

3. The system of claim 2 wherein the circulation means circulates the ink that is directed from the print head back to the print head.

4. The system of claim 2 wherein the channels include parts for moving the ink along two opposite sides of the print head.

5. The system of claim 1 wherein the location to which the print head is mounted is recessed in the pen body, and wherein part of the ink circulation passageway is defined in the recessed location.

6. The system of claim 1 wherein the ink has a changeable temperature level and moves into and out of the passageway irrespective of whether the print head is simultaneously operating to expel ink and irrespective of the temperature level of the ink.

7. The system of claim 1 wherein the circulation means includes temperature control means for regulating a temperature level of the moving ink.

8. The system of claim 7 wherein the temperature control means comprise a heat exchanger located adjacent to the ink that is moving into and out of the passageway.

9. The system of claim 1 wherein the pen body includes:

a second location to which is mounted a second print head that is operable to expel ink;

a second ink circulation passageway defined by the shape of the body, the second ink circulation passageway oriented to be in fluid communication with the second print head; and ducts formed in the body for connecting the first and second ink circulation passageways.

10. An ink-jet pen for use with a continuously circulating supply of ink, comprising:

a body having a recess formed therein;

a print head mounted within the recess and shaped to define at least one ink passageway along a substantial length of the print head;

a supply conduit connectable to the body for delivering ink to the body;

a return conduit connectable to the body for removing ink from the body;

channels defined by the shape of the body for circulating ink that is delivered to the body by the supply conduit through the ink passageway and for circulating ink from the liquid passageway to the return conduit;

a flexible circuit member covering the print head and shaped to define with the body and the print head, part of the ink passageway; and a deaeration system for removing air from the continuously circulating ink.

11. An ink-jet pen for use with a continuously circulating supply of ink, comprising:

a body having a recess formed therein;

a print head mounted within the recess and shaped to define at least one ink passageway along a substantial length of the print head and wherein the recess has long side edges and the body is shaped to define alignment features for aligning the print head in the recess spaced from the long side edges of the recess;

a supply conduit connectable to the body for delivering ink to the body;

a return conduit connectable to the body for removing ink from the body;

channels defined by the shape of the body for circulating ink that is delivered to the body by the supply conduit through the ink passageway and for circulating ink from the liquid passageway to the return conduit; and a deaeration system for removing air from the continuously circulating ink.

* * * * *